US011525557B2

(12) United States Patent
Hou et al.

(10) Patent No.: US 11,525,557 B2
(45) Date of Patent: Dec. 13, 2022

(54) DOWNLIGHT APPARATUS

(71) Applicant: XIAMEN ECO LIGHTING CO. LTD., Xiamen (CN)

(72) Inventors: Shouqiang Hou, Xiamen (CN); Yongzhe Dong, Xiamen (CN); Xiaoliang Wen, Xiamen (CN); Zhenyu Tang, Xiamen (CN); Zhehan Yang, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/381,989

(22) Filed: Apr. 11, 2019

(65) Prior Publication Data

US 2020/0326053 A1 Oct. 15, 2020

(51) Int. Cl.

| | |
|---|---|
| ***F21V 14/02*** | (2006.01) |
| ***F21S 8/02*** | (2006.01) |
| ***F21V 29/70*** | (2015.01) |
| ***F21V 17/00*** | (2006.01) |
| ***F21V 21/40*** | (2006.01) |
| ***F21V 5/04*** | (2006.01) |
| ***F21Y 113/13*** | (2016.01) |
| ***F21Y 115/10*** | (2016.01) |

(52) U.S. Cl.

CPC ..... *F21V 14/02* (2013.01); *F21S 8/026* (2013.01); *F21V 5/04* (2013.01); *F21V 17/002* (2013.01); *F21V 21/40* (2013.01); *F21V 29/70* (2015.01); *F21Y 2113/13* (2016.08); *F21Y 2115/10* (2016.08)

(58) Field of Classification Search

CPC . F21V 14/02; F21V 21/40; F21V 5/08; F21V 21/30; F21V 17/002; F21V 29/70; F21V 5/04; F21S 8/026; F21Y 2115/10; F21Y 2113/13; F21Y 2113/20

See application file for complete search history.

(56) References Cited

U.S. PATENT DOCUMENTS

| | | | | |
|---|---|---|---|---|
| 5,738,436 A * | 4/1998 | Cummings | F21S 2/00 | 362/294 |
| 5,951,155 A * | 9/1999 | Lanser | B60Q 3/44 | 362/490 |
| 6,578,994 B1 * | 6/2003 | Beyerlein | F21V 21/30 | 362/490 |
| 8,267,558 B1 * | 9/2012 | Glater | F21S 10/063 | 362/287 |
| 9,353,935 B2 * | 5/2016 | Holland | F21K 9/65 | |
| 9,429,298 B1 * | 8/2016 | Hetrick | G08B 7/062 | |
| 9,447,953 B2 * | 9/2016 | Lawlor | F21V 21/14 | |
| 9,927,106 B2 * | 3/2018 | Hsieh | F21V 14/02 | |

(Continued)

FOREIGN PATENT DOCUMENTS

| | | | | |
|---|---|---|---|---|
| CN | 207179427 U * | 4/2018 | F21V 21/30 | |
| EP | 2749809 A1 * | 7/2014 | F21V 21/30 | |
| WO | WO-2016007018 A1 * | 1/2016 | F21V 21/30 | |

*Primary Examiner* — Erin Kryukova

(74) *Attorney, Agent, or Firm* — Chun-Ming Shih; Lanway IPR Services

(57) ABSTRACT

A downlight apparatus has a rotatable base, a light module and a front cover. The light is rotatable in a spherical rotating space defined by the rotatable base. There is a stop structure for keeping the light module staying at rotating angle with respect to the rotatable base when there is no external force applying on the light module.

7 Claims, 12 Drawing Sheets

(56) References Cited

U.S. PATENT DOCUMENTS 9,982,855 B1* 5/2018 Tan ..... F21V 29/77
10,145,519 B1* 12/2018 Portinga ..... F21V 15/01
10,663,126 B2* 5/2020 Zhan ..... F21V 21/04
10,697,599 B1* 6/2020 Davis ..... F21K 9/69
2007/0019418 A1* 1/2007 Czech ..... F21S 8/02 362/364
2008/0112171 A1* 5/2008 Patti ..... F21V 21/30 362/365
2008/0273324 A1* 11/2008 Becker ..... F21V 5/007 362/237
2010/0061108 A1* 3/2010 Zhang ..... F21S 8/026 362/364
2011/0228544 A1* 9/2011 Dubord ..... F21S 2/005 362/368
2013/0051012 A1* 2/2013 Oehle ..... F21S 8/026 362/235
2013/0182417 A1* 7/2013 AmatGirbau ..... F21V 21/02 362/147
2013/0200818 A1* 8/2013 Cercone ..... H05B 45/00 315/292
2014/0003061 A1* 1/2014 Chen ..... F21S 8/026 362/311.02
2014/0160772 A1* 6/2014 Wu ..... F21S 8/026 362/373
2014/0233246 A1* 8/2014 Lafreniere ..... F21S 8/026 362/364
2016/0161096 A1* 6/2016 Boulanger ..... F21V 21/02 362/368
2016/0169490 A1* 6/2016 Kijima ..... F21V 21/15 362/235
2016/0195245 A1* 7/2016 Markey ..... F21V 14/04 362/147
2016/0323978 A1* 11/2016 Raza ..... H05B 47/19
2016/0327200 A1* 11/2016 Crooks ..... F16M 11/08
2017/0227201 A1* 8/2017 Fujisawa ..... F21V 19/02
2017/0254491 A1* 9/2017 Terumichi ..... F21S 8/026
2017/0299159 A1* 10/2017 Mjelde ..... F21V 31/005
2017/0328547 A1* 11/2017 Shapiro ..... F21V 21/30
2017/0343190 A1* 11/2017 Georgiev ..... F21V 23/023
2018/0210135 A1* 7/2018 Randolph ..... G02B 6/0055
2018/0356056 A1* 12/2018 Phillips ..... F21V 29/10
2020/0173636 A1* 6/2020 Georgiev ..... F21V 29/77
2022/0205622 A1* 6/2022 Sousa ..... F21V 21/15

* cited by examiner

DOWNLIGHT APPARATUS

FIELD

The present invention is related to a downlight apparatus and more particularly related to an adjustable downlight apparatus.

BACKGROUND

Downlight devices are widely used around the world. When LED technologies advance, more and more downlight devices are embedded with LED components.

There are still challenges and opportunities to design better downlight devices to enhance human life.

SUMMARY OF INVENTION

In some embodiments, a downlight apparatus includes a rotation base, a light module and a front cover.

The rotation base defines a spherical rotating space for containing an object and for the object to move in the spherical rotation space. The spherical rotation space is a virtual space defined by a boundary surface of the rotation base and not necessary to be completely covered by the boundary surface of the rotation base. In addition, the spherical space does not have to be 100% spherical, just allowing an object with a partial round exterior surface to rotate with respect to the boundary surface of the rotation base.

The light module is at least partially enclosed by the rotation base and having an exterior surface corresponding to the spherical rotating space. The light module contains a housing and light circuit like LED modules. In some embodiments, the LED modules are disposed on a light source plate fixed to a cavity of the housing of the light module.

The rotation base has one or more stop structures for keeping the light module at a rotation angle with respect to the rotation base while no external force applying on the light module. For example, there are two wings or three wings disposed at an inner surface of the rotation base engaging an exterior surface of the light module. Rubber or other units for increasing friction between the light module and the rotation base may be added to enhance stable connection and position of the light module.

There is a front cover fixed to the rotation base for holding the light module. The front cover may be fixed to the rotation base together forming the spherical rotating space. In other words, the light module is not completely fixed to any of the rotation base or the front cover. Instead, the light module is confined by the combination of the rotation base and the front cover, but still keep rotatable movement while being operated by a user.

The front cover defines a light opening so that an output is emitted outside the light opening. There may be a diffusion layer, e.g. a transparent cover for diffusing output light, covering the light opening.

In some embodiments, when the diffusion layer may enclose the light module so that users cannot reach and rotate the light module with respect to the rotation base. In other words, such design by concealing the light module inside front cover without being touchable, increases certain safety while keeping flexibility during installation of the downlight apparatus.

In some other embodiments, a bottom of the light module is exposed via the light opening of the light opening so that users may touch the light module and rotate the light module with respect to the rotation base.

In some embodiments, the light module contains multiple types of LED modules with different optical output characteristics. For example, the same light module may include LED modules of different color temperatures or colors. For example, red, blue, green and two white LED modules may be disposed in the light module, while the two white LED modules may emit lights of different color temperatures.

By adjusting relative strengths or on and off of the LED modules, the light module may be controlled to emit various types of light as required.

Some wireless circuit may even be disposed to the downlight for enabling a remote control via an external device like a mobile phone or a remote control for turning on, turning off, adjusting luminous levels, changing colors or changing color temperatures of a output light of the light module.

In some embodiments, the multiple types of LED modules are disposed on a light source plate fixed in the light module. The light source plate may be placed at central top, remaining a distance to the light opening to prevent glare effect.

The LED modules may be disposed at peripheral sides of the light module and a light guide, which is made of transparent plastic material for receiving light from a lateral side and evenly emit soften light from a surface plane, is used for guiding the output light to desired directions.

In some embodiments, there are multiple sets of LED modules disposed in the light module for providing output lights of different optical characteristics, including colors, temperatures, directions.

Some reflective material or reflective structure, like a reflection cup may be disposed for guiding light to the light opening to increase light efficiency.

In some embodiments, there is a inner dome space between a light module housing of the light module and the light source plate. Specifically, in such design, the light module has a spherical top by decreasing a diameter from a bottom near the light opening to a top of the light module.

In such design, there is an inner dome space between the light source plate and the inner surface of the housing of the light module. A heat sink like a metal piece that efficiently transmits heat may be placed in the inner dome space for enhancing heat dissipation.

In some embodiments, the multiple types LED modules are adjusted to generate a light output from the light opening corresponding to the rotation angle. In such design, the rotation operation is also an indication to the light module for changing control parameters of LED modules of the light module.

For example, some sensor structure may be disposed on the light module or the rotation base for detecting a current rotation angle between the light module and the rotation base. The rotation angle message is transmitted to a driver circuit physically, electronically or mechanically so as to drive the LED modules to function accordingly based on predetermined settings.

For example, when the light module is tilt with an angle, the LED modules of the light module may be adjusted with larger current or generating a different mixed color temperature.

In some embodiments, the light module is rotatable to keep a tilt angle with respect to a central axis perpendicular to the light opening. The central axis is a virtual line passing through a center and perpendicular to the light opening of the surface cover. For example, by rotating the light module with respect to the rotation base, an output light may have a 30, 45, 60 tilt degrees with respect to the central axis. When the light module is rotatable in a spherical rotating space, the same tilt angle may be adjusted for directing to different horizontal angles.

In some embodiments, the light module is not limited and is rotatable surrounding the central axis. In other words, such rotation is not only providing a tilt angle directing to different horizontal positions, but providing a rotation along the central axis. In other words, the light module is operable for rotating circularly for a rotation range. Specifically, the central axis of the light module is rotated with respect to the central axis of the light opening, instead of just having a tilt angle with respect to the central axis of light opening.

In such design, the rotation range, e.g. 30 degrees, 180 degrees, 90 degrees, may be corresponded to different settings. In other words, by rotating the central axis of the light module with respect to the central axis of the light opening, working modes of the light module may be adjusted.

For example, the top end of the light module, which is connected to a driver box is rotated when the central axis of the light module is rotated with respect to the central axis of the light opening. Such rotation message may be delivered to the driver circuit in the driver box to adjust working modes of the light modules, e.g. providing different color temperatures, different colors, different working modes.

In some embodiments, the rotation base has a top opening for the light module connecting to a power source module. Specifically, the light module is connected to a driver box or an external power source via the top opening.

In some embodiments, the rotation base includes a base housing and a limiting ring. The limiting ring is disposed inside the base housing. An inner surface of the limiting ring contacts the exterior surface of the light module. The limiting ring is designed to pressing an elastic force upon surface of the light module to keep the light module to stay at a rotation angle with respect to the rotation base when no external force is applied thereon.

In some embodiments, the stop structure is an extended portion with a bottom end connected to the limiting ring and a top end engages the exterior surface of the light module. For example, the limiting ring has a wider diameter at its bottom that is closer to the light opening and has a narrower diameter at its top. The stop structure may be several wings extended inwardly to engage the exterior surface of the light module more closely.

In some embodiments, the exterior surface of light module and the inner surface of the limiting ring has corresponding multiple concaveconvex structures for keeping the light module staying at associated rotation angles with respect to the rotation base. Specifically, in addition to roughen the surfaces of the light module and the limiting ring, corresponding concaveconvex structures may be disposed on their surfaces. In such design, the movement between the light module and the limiting ring is kept with a larger force when corresponding concaveconvex structure match to each other.

In some embodiments, the stop structure may have a rubber unit fixed to the top end for engaging the exterior surface of the light module. Other material for increasing friction may also be used in similar designs.

In some embodiments, there are multiple shallow grooves disposed on the exterior surface of the light module and the top end of the stop structure is movable to stay in one of the shallow groove to enhance fixing between the light module and the rotation base. Such design provides segmental adjustment, instead of continuous adjustment, which is more favorable in some situations.

In some embodiments, the downlight apparatus may also have a lock unit for selectively locking the rotation angle between the light module and the rotation base. The lock unit may be various types of locking structures, for keeping the light module fixed to the rotation base when the lock unit is functioned.

In some embodiments, the downlight apparatus may also have a lens module connected to the light module. The lens module may be rotatable with respect to the light module to adjust light distribution of a output light. For example, by rotating the lens module, the distance between the lens and the LED modules of the light module is changed, and thus changing light beam parameter of an output light.

In some embodiments, the downlight apparatus may include a lens module connected to the light module for adjusting an output light. The lens module may have a replacing structure to be replaced with another lens module to change the output light. For example, the light module may be concealed by an original cover. In addition to the original cover, another lens module may be detachably attached to the light module for further changing output light characteristics more flexibly.

In some embodiments, there may be a handle fixed to the light module for manually rotating the light module with respect to the rotation base. As mentioned above, the light module may be rotated for a tilt angle, or rotated with respect to the light opening. With an handle, users may hold the handle to control the rotation more conveniently and accurately.

In some embodiments, in addition being used for rotating the light module, the handle may be rotatable, pressed, or operated in various manner for changing settings of the light module, in addition to light direction changing of the light module. For example, different operation modes, different colors, different color temperatures may be set by operating the handle.

The handle may be a protruding bar, which may be foldable, or in other forms for operation convenience.

In some embodiments, the downlight apparatus also has a driver box supplying power to the light module. The driver box is connected to the light module with a rotatable terminal. In some other embodiments, there is a limiting structure for limiting the rotation between the light module ad the rotation base to prevent damage of the connection between the light module and the rotation base.

DETAILED DESCRIPTION

Figure 1:
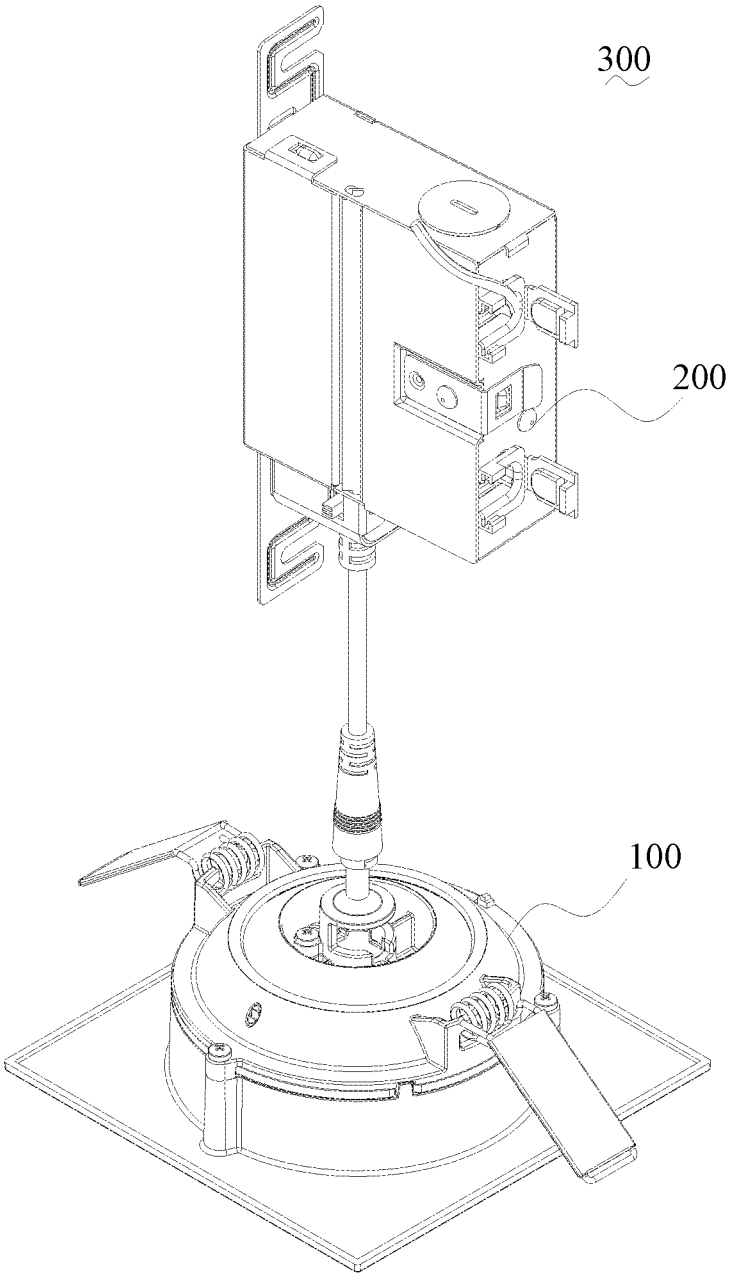
FIG. 1 illustrates a downlight apparatus embodiment.

Please refer to FIG. 1 to FIG. 4, which illustrate a downlight apparatus that has a light module rotatable with respect to a rotation base. The same reference numerals used in the specification indicate the same component.

Figure 2:
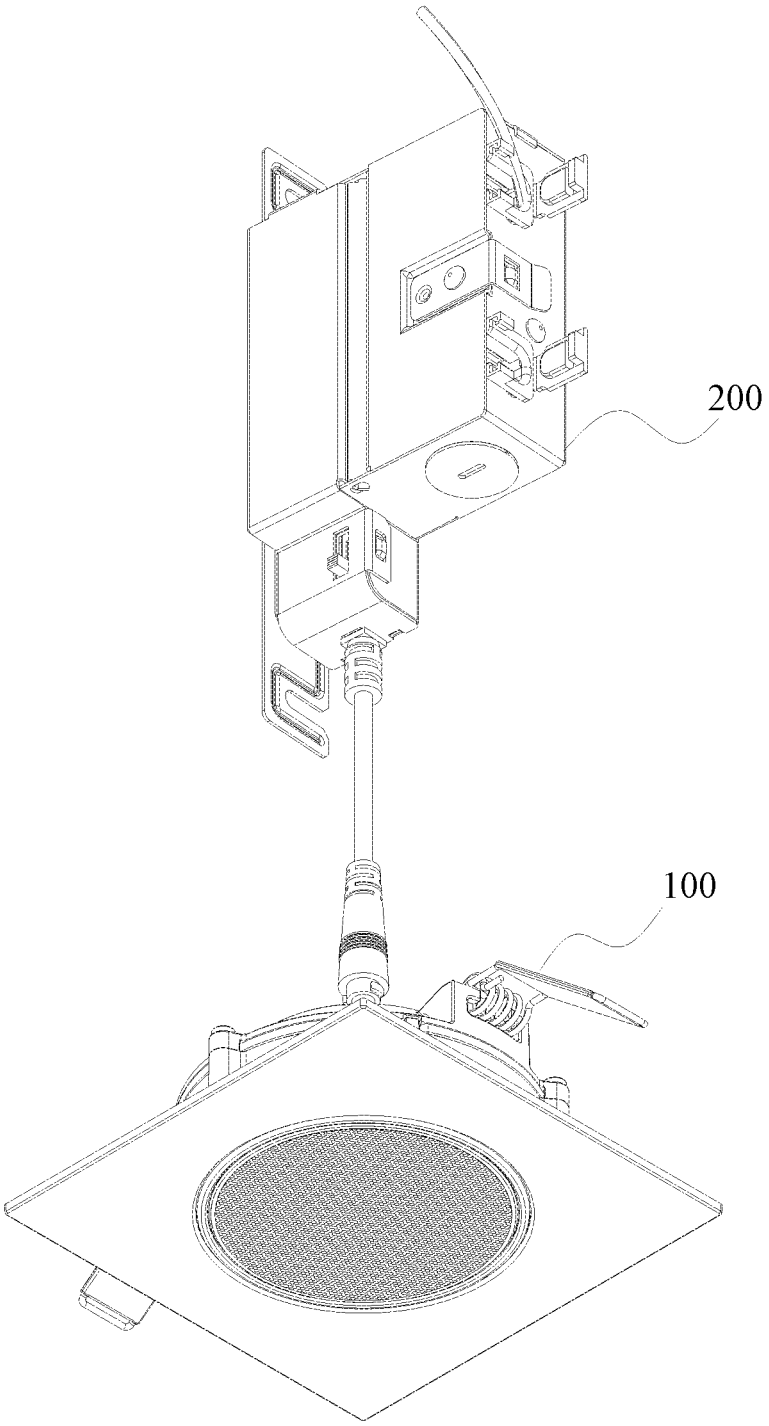
FIG. 2 illustrates another view of the embodiment of FIG. 1.
Figure 3:
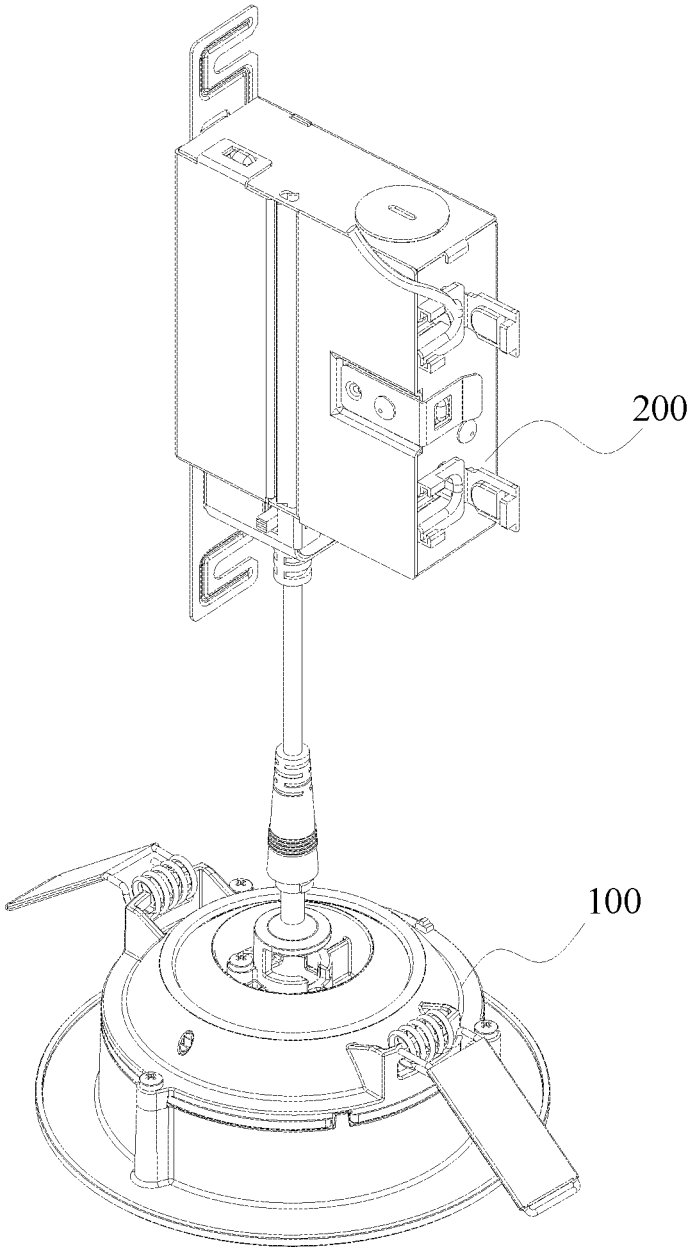
FIG. 3 illustrates another view of the embodiment of FIG. 1.
Figure 4:
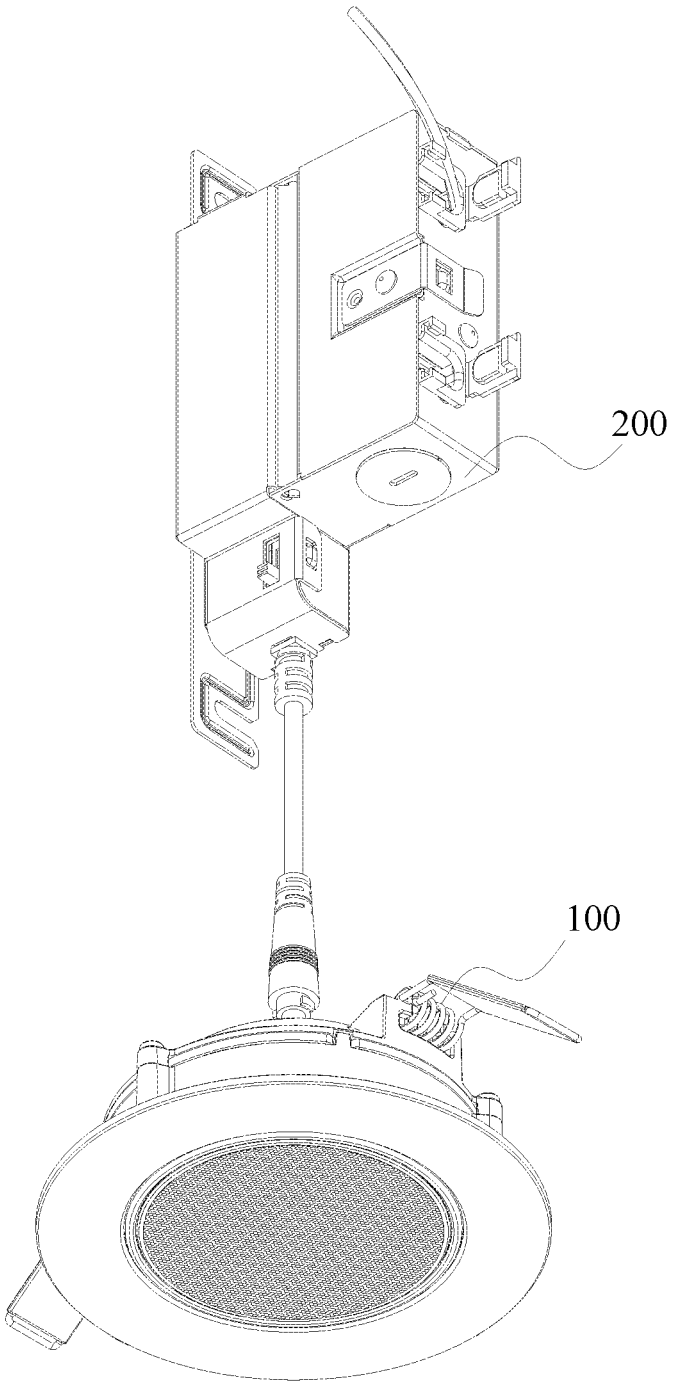
FIG. 4 illustrates another view of the embodiment of FIG. 1.

In FIG. 1 to FIG. 3, a downlight apparatus 300 has a driver box 200 and a light body 100. The light body 100 contains a rotation base, a light module and a surface cover. The driver box 200 provides a driving current to LED modules of the light module in the light body 100.

Figure 5:
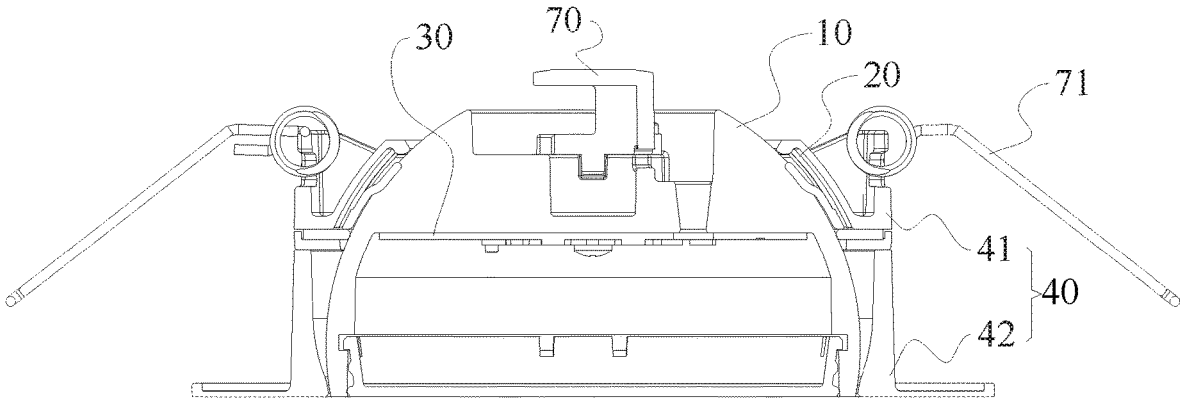
FIG. 5 illustrates a side cross-sectional view of the embodiment.
Figure 6:
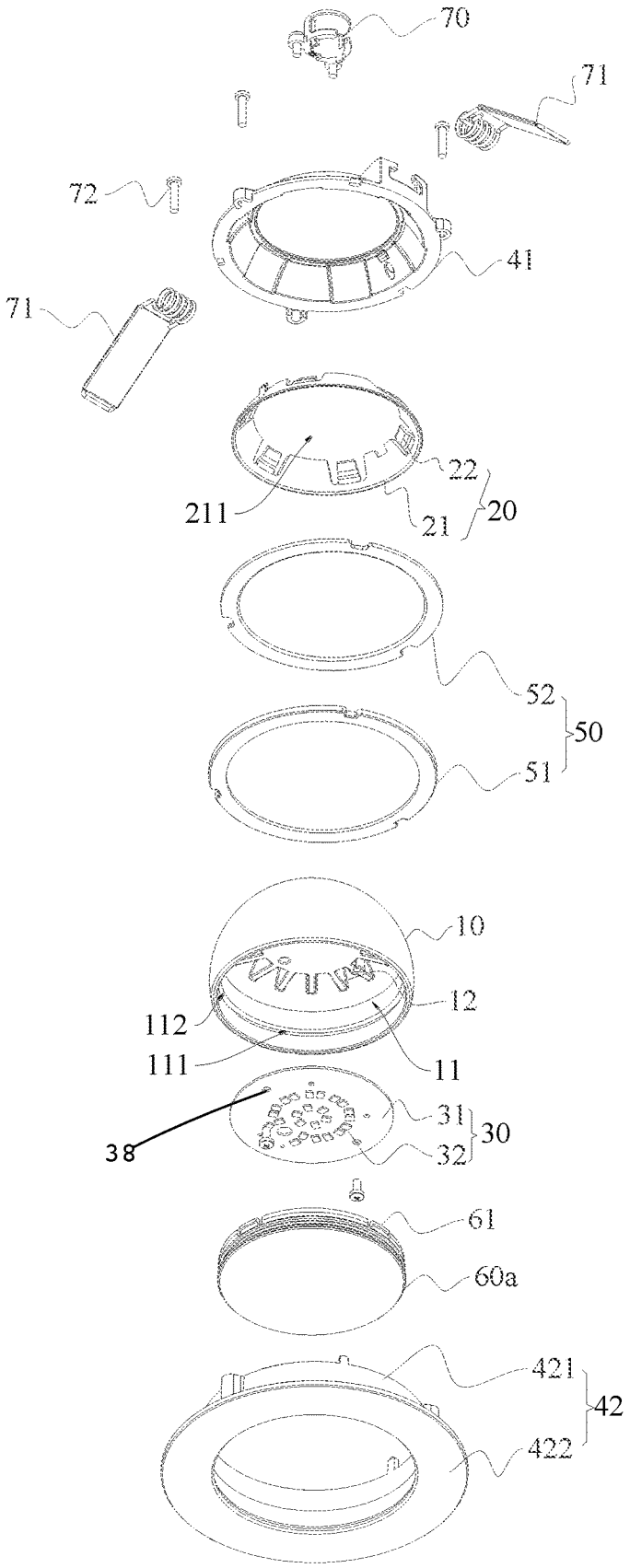
FIG. 6 illustrates components of the embodiment.

Please refer to FIG. 5 to FIG. 6. The light body 100 includes a light module 10 and a rotation base. The light module 10 includes a light source plate 30 which may be mounted with multiple types of LED modules for mixing output lights of various parameters, e.g. different colors, different color temperatures.

The rotation base, in this example, includes a limiting ring 20 and a main housing 40. The main housing 40 has a surface cover 42 and a base housing 41. The light module 10 has a spherical exterior surface corresponding to a spherical rotating space defined by the rotation base and is rotatable with respect to the rotation base. The limiting ring 20 is disposed inside the rotation base facing the light module 10. There are two springs 71 for fixing the downlight apparatus to a cavity of a ceiling. There is a terminal disposed on top of the light module 10 for connecting to a driver box explained in more detail as follows.

The light module 11 has a containing space 11 and a light opening 112. The light source plate 30 contains a substrate 31 and multiple LED modules 32 is disposed in the containing space 11.

Screws 72 may be used for fixing the light source plate to the light module 10. The rotation base defines a spherical rotating space 211 corresponding to an exterior surface of the light module 10.

The light module 10 may be rotated with a tilt angle with respect to a central axis that passes through a center of a light opening and perpendicular to the light opening of the surface cover 42. In some embodiments, the light module 10 may also be rotated with respect to the central axis of the light opening of the surface cover 42. Specifically, there is a virtual axis passing through a center of the light source plate and perpendicular to the light source plate. The central axis of the light module 10 may be rotated with respect to the central axis of the light opening of the surface cover 42 or tilted with an angle.

The limiting ring 20 may have a sleeve 21 that defines a rotating space 211 and have an elastic plate 22 for pressing exterior surface of the light module 10 to increase stable connection when no external force applies to the light module 10.

Multiple heat sink plates 12 may be disposed in the containing space 11 between the light source plate and inner top of the light module.

In FIG. 6, there is a reflection cup 60*a* for providing a wide light beam with 80 to 120 degrees.

Figure 7:
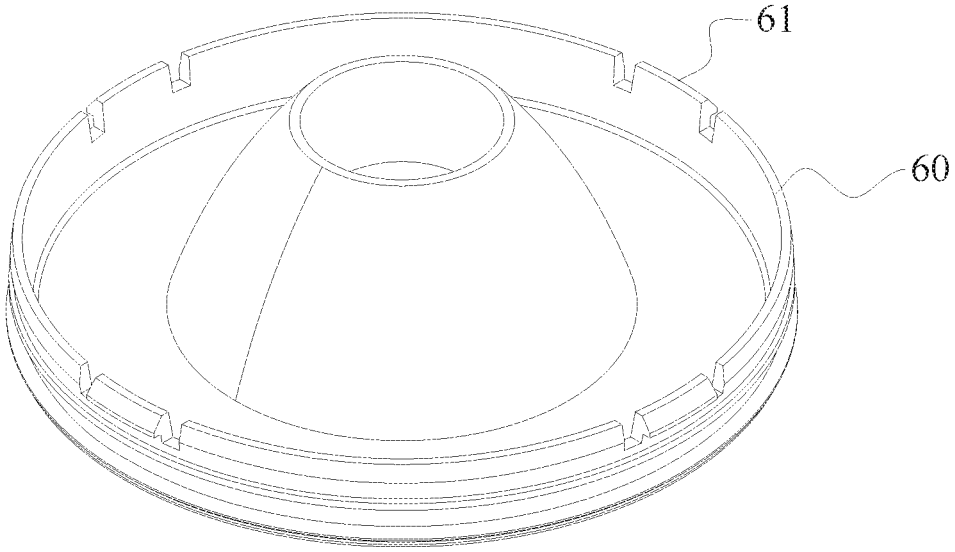
FIG. 7 illustrates a lens module used in an embodiment.

In FIG. 7, there is a lens module 60 for providing a light beam with 6 to 80 degrees.

There is a groove 111 disposed in the light module 10 for fixing hooks 61 corresponding to the groove 111.

Figure 8:
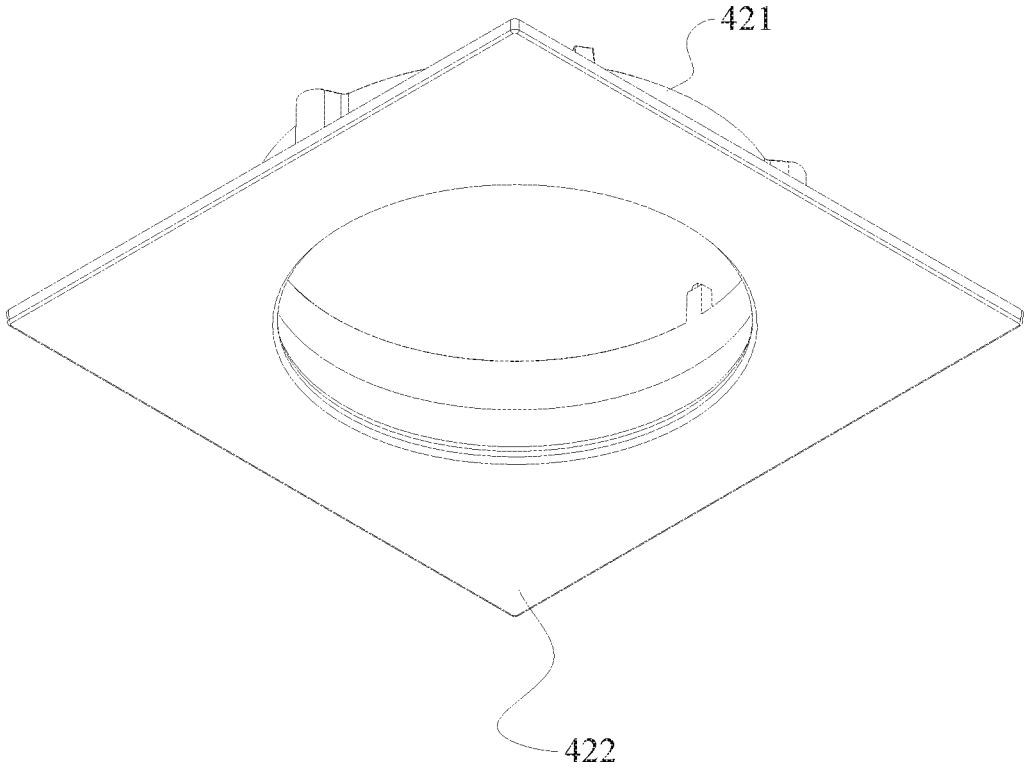
FIG. 8 illustrates a surface cover example.
Figure 9:
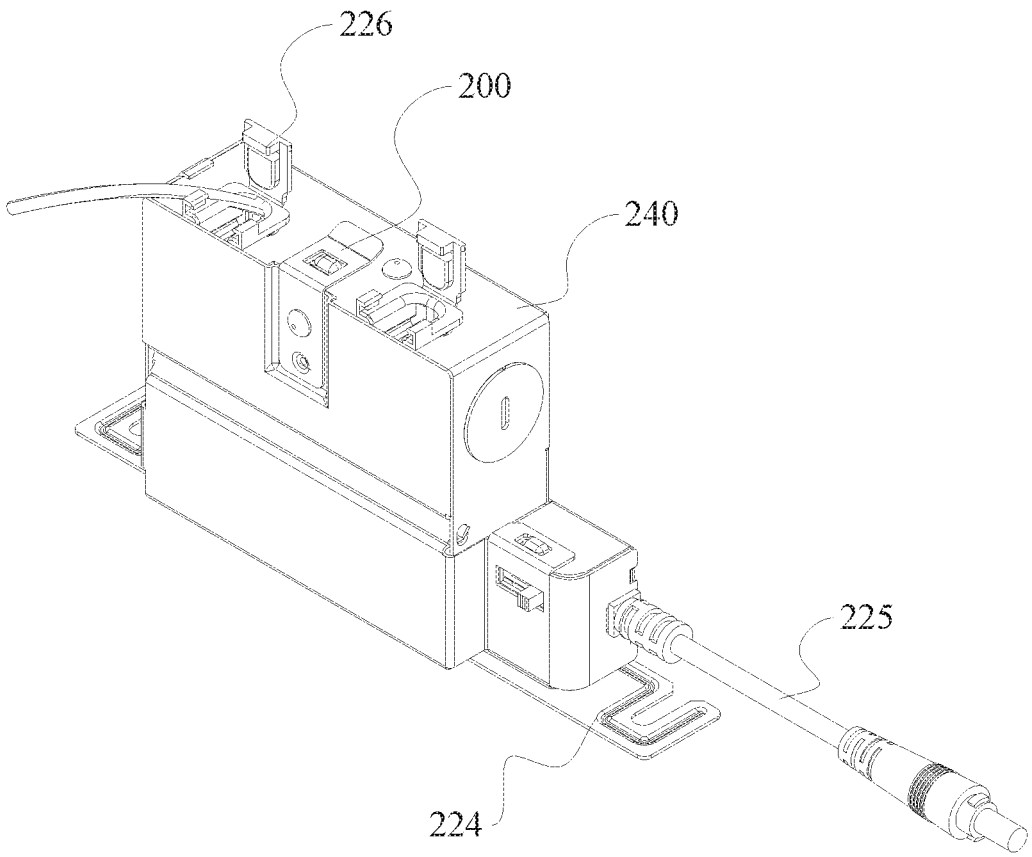
FIG. 9 illustrates a driver box design.
Figure 10:
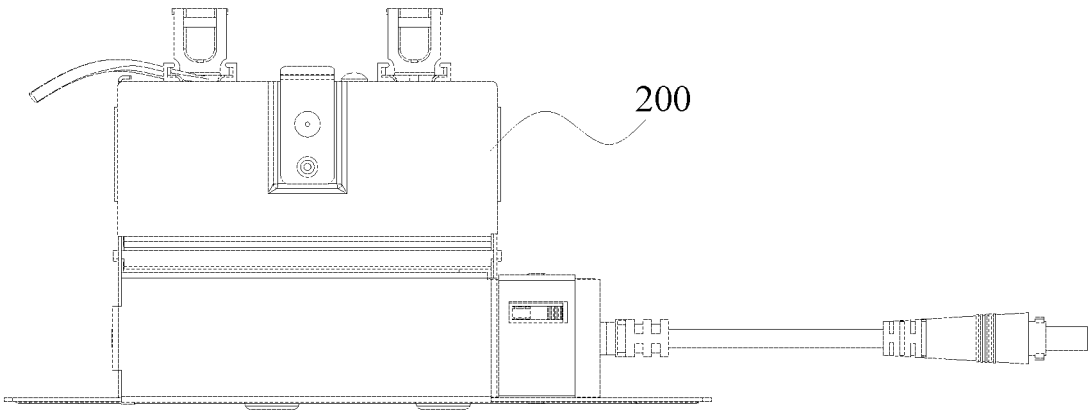
FIG. 10 illustrates a side view of FIG. 9.
Figure 11:
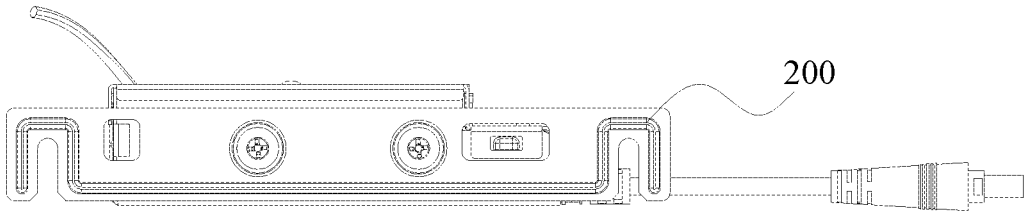
FIG. 11 illustrates a top view of FIG. 9.
Figure 12:
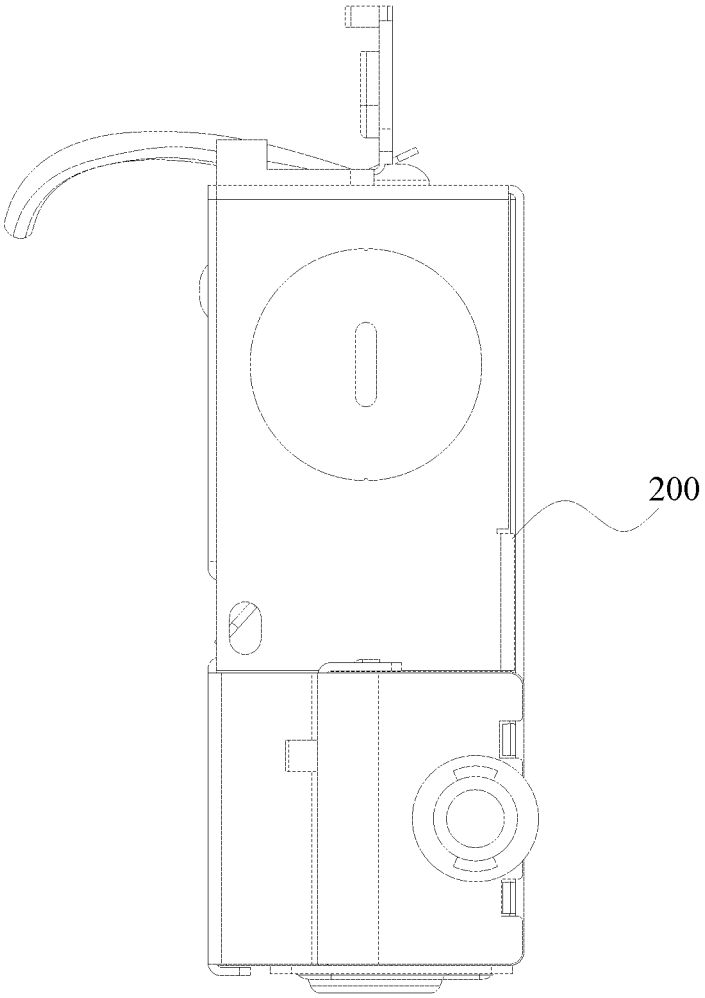
FIG. 12 illustrates a bottom view of FIG. 9.
Figure 13:
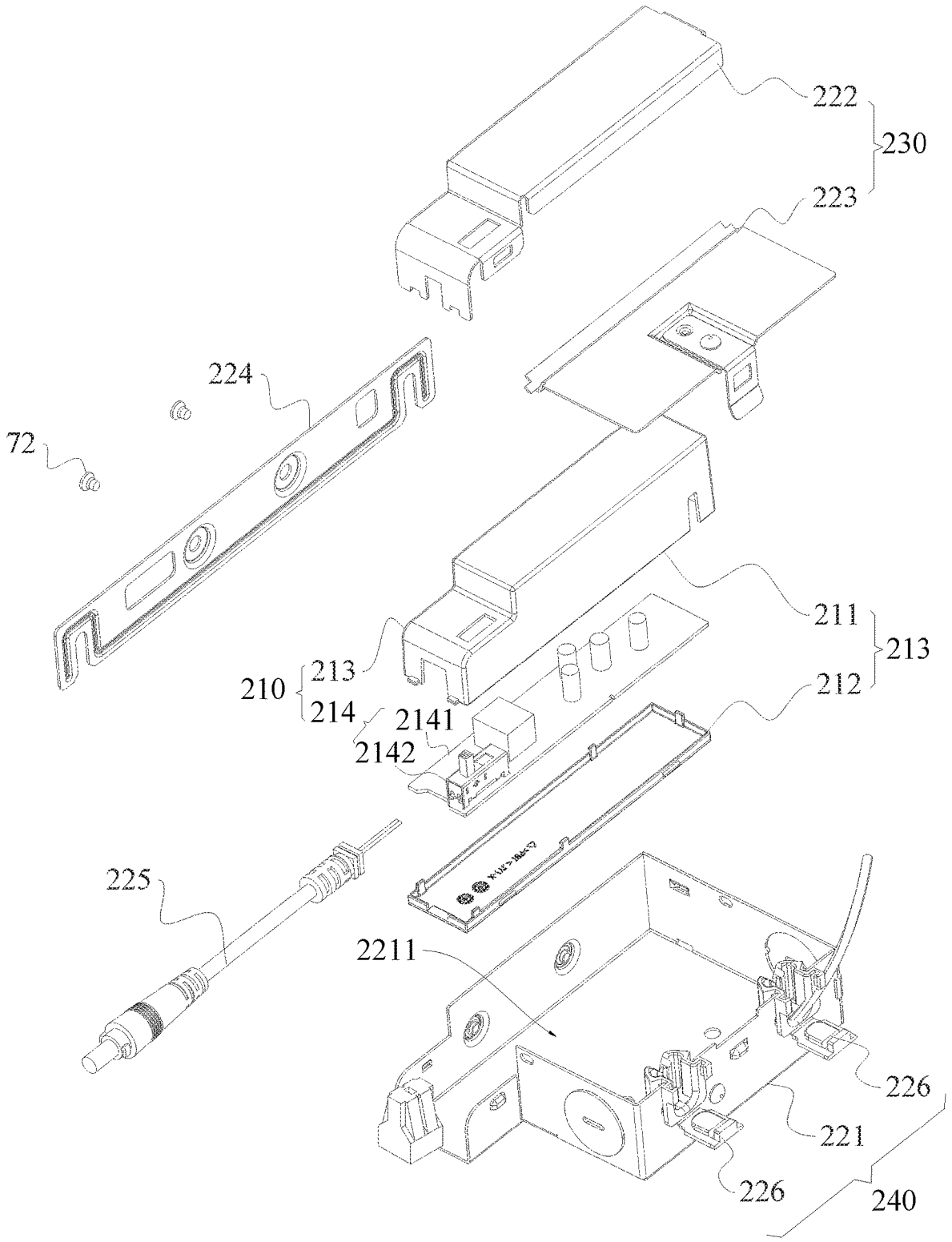
FIG. 13 is an exploded view of components of the driver box in FIG. 9.
Figure 14:
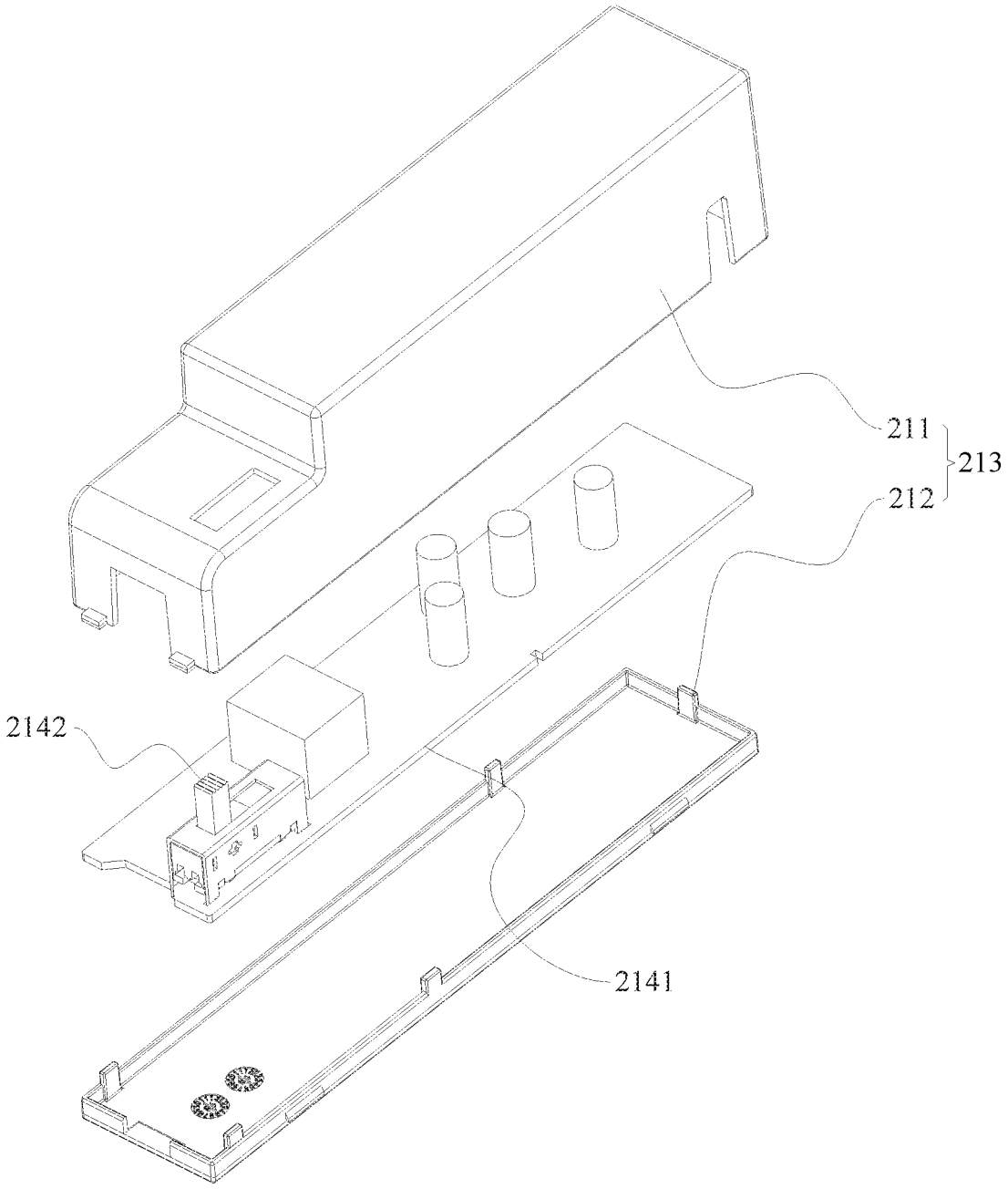
FIG. 14 illustrates another driver box with a manual switch.
Figure 15:
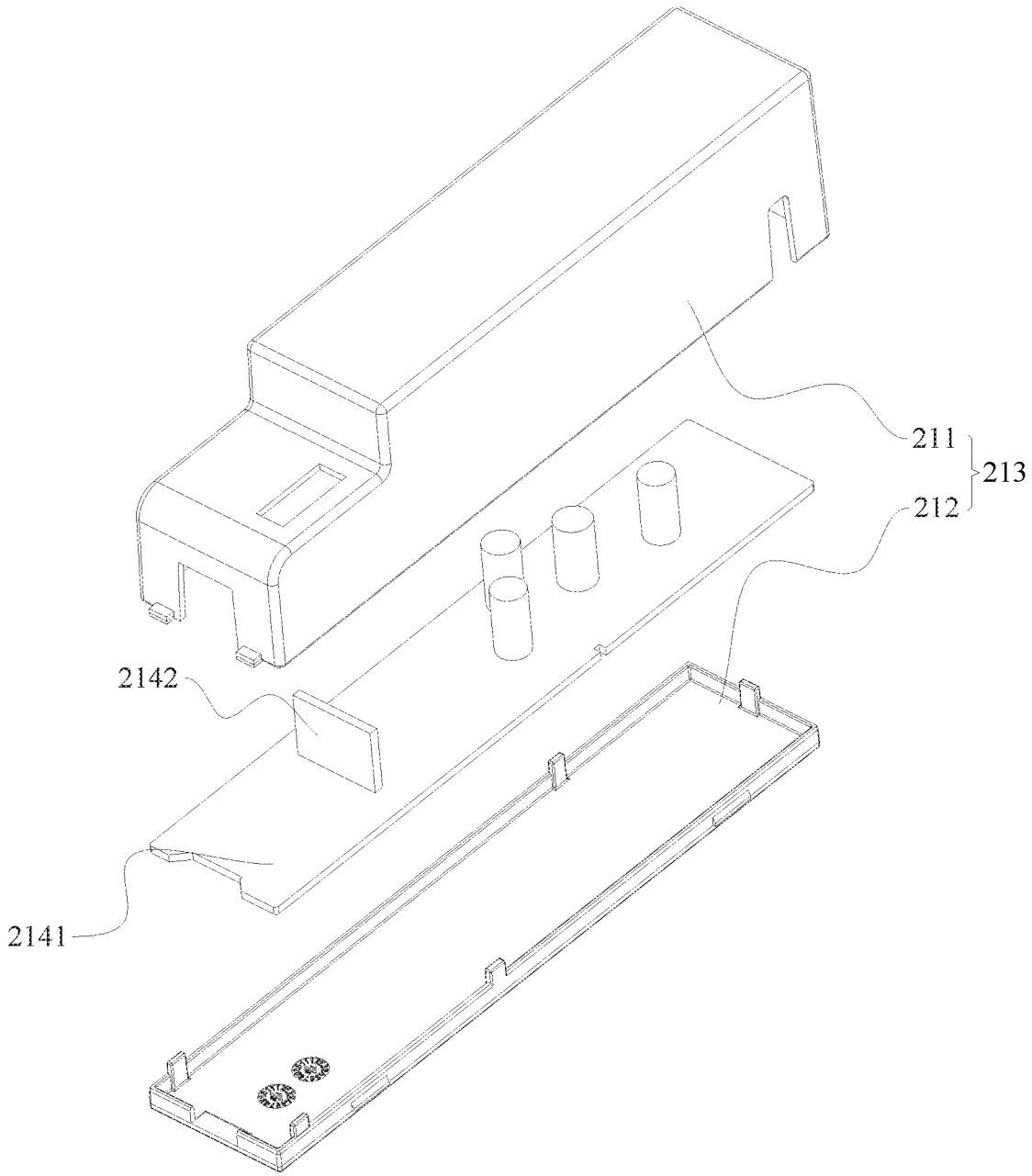
FIG. 15 illustrates another driver box example.

In FIG. 6, the surface cover 422 may have different shapes like the rectangular shape 422 in FIG. 8.

There may be a water-proof concealing structure 50, which includes a conceal ring 51 and a groove 52 of the cup 51.

Please refer to FIG. 9 to FIG. 12. The downlight apparatus 300 also includes a driver box 200 and a wire 225.

The driver box 200 contains a driver 210 that includes a container box 213 and a driver circuit 213 in the container box 213. There is a driver plate 2141 and a manual switch 2142 for switching operating modes of the LED modules.

The housing structure 241 is used for installing the driver 210. The housing structure 241 includes a base 221 that has an opening 2211 and a cover 230. The cover 230 includes two sub-covers 223 and 222.

There is a wire pressing lock 226 for pressing wires. There is also a clip 71 for connecting to the cover structure 41.

In some embodiments, a downlight apparatus includes a rotation base, a light module and a front cover.

The rotation base defines a spherical rotating space for containing an object and for the object to move in the spherical rotation space. The spherical rotation space is a virtual space defined by a boundary surface of the rotation base and not necessary to be completely covered by the boundary surface of the rotation base. In addition, the spherical space does not have to be 100% spherical, just allowing an object with a partial round exterior surface to rotate with respect to the boundary surface of the rotation base.

The light module is at least partially enclosed by the rotation base and having an exterior surface corresponding to the spherical rotating space. The light module contains a housing and light circuit like LED modules. In some embodiments, the LED modules are disposed on a light source plate fixed to a cavity of the housing of the light module.

The rotation base has one or more stop structures for keeping the light module at a rotation angle with respect to the rotation base while no external force applying on the light module. For example, there are two wings or three wings disposed at an inner surface of the rotation base engaging an exterior surface of the light module. Rubber or other units for increasing friction between the light module and the rotation base may be added to enhance stable connection and position of the light module.

There is a front cover fixed to the rotation base for holding the light module. The front cover may be fixed to the rotation base together forming the spherical rotating space. In other words, the light module is not completely fixed to any of the rotation base or the front cover. Instead, the light module is confined by the combination of the rotation base and the front cover, but still keep rotatable movement while being operated by a user.

The front cover defines a light opening so that an output is emitted outside the light opening. There may be a diffusion layer, e.g. a transparent cover for diffusing output light, covering the light opening.

In some embodiments, when the diffusion layer may enclose the light module so that users cannot reach and rotate the light module with respect to the rotation base. In other words, such design by concealing the light module inside front cover without being touchable, increases certain safety while keeping flexibility during installation of the downlight apparatus.

In some other embodiments, a bottom of the light module is exposed via the light opening of the light opening so that users may touch the light module and rotate the light module with respect to the rotation base.

In some embodiments, the light module contains multiple types of LED modules with different optical output characteristics. For example, the same light module may include LED modules of different color temperatures or colors. For example, red, blue, green and two white LED modules may be disposed in the light module, while the two white LED modules may emit lights of different color temperatures.

By adjusting relative strengths or on and off of the LED modules, the light module may be controlled to emit various types of light as required.

Some wireless circuit may even be disposed to the downlight for enabling a remote control via an external device like a mobile phone or a remote control for turning on, turning off, adjusting luminous levels, changing colors or changing color temperatures of a output light of the light module.

In some embodiments, the multiple types of LED modules are disposed on a light source plate fixed in the light module. The light source plate may be placed at central top, remaining a distance to the light opening to prevent glare effect.

The LED modules may be disposed at peripheral sides of the light module and a light guide, which is made of transparent plastic material for receiving light from a lateral side and evenly emit soften light from a surface plane, is used for guiding the output light to desired directions.

In some embodiments, there are multiple sets of LED modules disposed in the light module for providing output lights of different optical characteristics, including colors, temperatures, directions.

Some reflective material or reflective structure, like a reflection cup may be disposed for guiding light to the light opening to increase light efficiency.

In some embodiments, there is an inner dome space between a light module housing of the light module and the light source plate. Specifically, in such design, the light module has a spherical top by decreasing a diameter from a bottom near the light opening to a top of the light module.

In such design, there is an inner dome space between the light source plate and the inner surface of the housing of the light module. A heat sink like a metal piece that efficiently transmits heat may be placed in the inner dome space for enhancing heat dissipation.

In some embodiments, the multiple types LED modules are adjusted to generate a light output from the light opening corresponding to the rotation angle. In such design, the rotation operation is also an indication to the light module for changing control parameters of LED modules of the light module.

For example, some sensor structure 38 in FIG. 6 may be disposed on the light module or the rotation base for detecting a current rotation angle between the light module and the rotation base. The rotation angle message is transmitted to a driver circuit physically, electronically or mechanically so as to drive the LED modules to function accordingly based on predetermined settings.

For example, when the light module is tilt with an angle, the LED modules of the light module may be adjusted with larger current or generating a different mixed color temperature.

In some embodiments, the light module is rotatable to keep a tilt angle with respect to a central axis perpendicular to the light opening. The central axis is a virtual line passing through a center and perpendicular to the light opening of the surface cover. For example, by rotating the light module with respect to the rotation base, a output light may have a 30, 45, 60 tilt degrees with respect to the central axis. When the light module is rotatable in a spherical rotating space, the same tilt angle may be adjusted for directing to different horizontal angles.

In some embodiments, the light module is not limited and is rotatable surrounding the central axis. In other words, such rotation is not only providing a tilt angle directing to different horizontal positions, but providing a rotation along the central axis. In other words, the light module is operable for rotating circularly for a rotation range. Specifically, the central axis of the light module is rotated with respect to the central axis of the light opening, instead of just having a tilt angle with respect to the central axis of light opening.

In such design, the rotation range, e.g. 30 degrees, 180 degrees, 90 degrees, may be corresponded to different settings. In other words, by rotating the central axis of the light module with respect to the central axis of the light opening, working modes of the light module may be adjusted.

For example, the top end of the light module, which is connected to a driver box is rotated when the central axis of the light module is rotated with respect to the central axis of the light opening. Such rotation message may be delivered to the driver circuit in the driver box to adjust working modes of the light modules, e.g. providing different color temperatures, different colors, different working modes.

In some embodiments, the rotation base has a top opening for the light module connecting to a power source module. Specifically, the light module is connected to a driver box or an external power source via the top opening.

In some embodiments, the rotation base includes a base housing and a limiting ring. The limiting ring is disposed inside the base housing. An inner surface of the limiting ring contacts the exterior surface of the light module. The limiting ring is designed to pressing an elastic force upon surface of the light module to keep the light module to stay at a rotation angle with respect to the rotation base when no external force is applied thereon.

In some embodiments, the stop structure is an extended portion with a bottom end connected to the limiting ring and a top end engages the exterior surface of the light module. For example, the limiting ring has a wider diameter at its bottom that is closer to the light opening and has a narrower diameter at its top. The stop structure may be several wings extended inwardly to engage the exterior surface of the light module more closely.

In some embodiments, the exterior surface of light module and the inner surface of the limiting ring has corresponding multiple concaveconvex structures for keeping the light module staying at associated rotation angles with respect to the rotation base. Specifically, in addition to roughen the surfaces of the light module and the limiting ring, corresponding concaveconvex structures may be disposed on their surfaces. In such design, the movement between the light module and the limiting ring is kept with a larger force when corresponding concaveconvex structure match to each other.

In some embodiments, the stop structure may have a rubber unit fixed to the top end for engaging the exterior surface of the light module. Other material for increasing friction may also be used in similar designs.

In some embodiments, there are multiple shallow grooves disposed on the exterior surface of the light module and the top end of the stop structure is movable to stay in one of the shallow groove to enhance fixing between the light module and the rotation base. Such design provides segmental adjustment, instead of continuous adjustment, which is more favorable in some situations.

In some embodiments, the downlight apparatus may also have a lock unit for selectively locking the rotation angle between the light module and the rotation base. The lock unit may be various types of locking structures, for keeping the light module fixed to the rotation base when the lock unit is functioned.

In some embodiments, the downlight apparatus may also have a lens module connected to the light module. The lens module may be rotatable with respect to the light module to adjust light distribution of an output light. For example, by rotating the lens module, the distance between the lens and the LED modules of the light module is changed, and thus changing light beam parameter of an output light.

In some embodiments, the downlight apparatus may include a lens module connected to the light module for adjusting an output light. The lens module may have a replacing structure to be replaced with another lens module to change the output light. For example, the light module may be concealed by an original cover. In addition to the original cover, another lens module may be detachably attached to the light module for further changing output light characteristics more flexibly.

In some embodiments, there may be a handle fixed to the light module for manually rotating the light module with respect to the rotation base. As mentioned above, the light module may be rotated for a tilt angle, or rotated with respect to the light opening. With an handle, users may hold the handle to control the rotation more conveniently and accurately.

In some embodiments, in addition being used for rotating the light module, the handle may be rotatable, pressed, or operated in various manner for changing settings of the light module, in addition to light direction changing of the light module. For example, different operation modes, different colors, different color temperatures may be set by operating the handle.

The handle may be a protruding bar, which may be foldable, or in other forms for operation convenience.

In some embodiments, the downlight apparatus also has a driver box supplying power to the light module. The driver box is connected to the light module with a rotatable terminal. In some other embodiments, there is a limiting structure for limiting the rotation between the light module ad the rotation base to prevent damage of the connection between the light module and the rotation base.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A downlight apparatus, comprising:

a main housing, defining a spherical rotating space;

a light module enclosed by the main housing and having an exterior surface corresponding to the spherical rotating space, the main housing has a limiting ring for keeping the light module at a rotation angle with respect to the main housing, the light module including multiple types of LED modules;

a driver circuit which stores predetermined settings for generating a light output based on the rotation angle of the light module;

a sensor structure disposed on the light module; and a surface cover fixed to the main housing for holding the light module, the surface cover defining a light opening, wherein the sensor structure detects the rotation angle of the light module and sends a signal including the rotation angle to the driver circuit, and the driver circuit receives the signal and changes control parameters of the multiple types of LED modules based on the predetermined settings to generate a light output from the light opening corresponding to the rotation angle.

2. The downlight apparatus of claim 1, wherein the multiple types of LED modules are with different optical output characteristics.

3. The downlight apparatus of claim 2, wherein the multiple types of LED modules are disposed on a light source plate fixed in the light module.

4. The downlight apparatus of claim 1, wherein there are different rotation ranges corresponding to different optical characteristics of the output light.

5. The downlight apparatus of claim 1, further comprising a rotation base having a top opening for connecting the light module to a power source module.

6. The downlight apparatus of claim 5, wherein the main housing includes a base housing and the limiting ring, the limiting ring is disposed inside the base housing, and an inner surface of the limiting ring contacts the exterior surface of the light module.

7. The downlight apparatus of claim 1, further comprising a lens module connected to the light module, the lens module is rotatable with respect to the light module to adjust light distribution of the output light.

* * * * *